US008029114B2

(12) United States Patent
Spee et al.

(10) Patent No.: US 8,029,114 B2
(45) Date of Patent: Oct. 4, 2011

(54) METHOD OF USING A CONTAINER FOR HOUSING AND TRANSPORTING INK CARTRIDGES AND FOR COLLECTING WASTE INK

(75) Inventors: Emil Spee, Hegelsom (NL); Frank Johan Hubert Nottelman, Belfeld (NL)

(73) Assignee: Océ-Technologies B.V., Venlo (NL)

( * ) Notice: Subject to any disclaimer, the term of this patent is extended or adjusted under 35 U.S.C. 154(b) by 1059 days.

(21) Appl. No.: 11/790,423

(22) Filed: Apr. 25, 2007

(65) Prior Publication Data

US 2007/0285485 A1 Dec. 13, 2007

(30) Foreign Application Priority Data

Apr. 26, 2006 (EP) ..... 06113121

(51) Int. Cl.
*B41J 2/175* (2006.01)

(52) U.S. Cl. ..... 347/86; 347/36; 347/99

(58) Field of Classification Search ..... 347/23, 347/36, 84–88, 99, 108
See application file for complete search history.

(56) References Cited

U.S. PATENT DOCUMENTS

| | | | | |
|---|---|---|---|---|
| 5,621,450 | A * | 4/1997 | Kawai et al. | 347/108 |
| 5,630,510 | A * | 5/1997 | Lamb et al. | 347/88 |
| 6,286,946 | B1 * | 9/2001 | Umemura et al. | 347/86 |
| 7,018,029 | B2 * | 3/2006 | Ishizawa et al. | 347/86 |

FOREIGN PATENT DOCUMENTS

| | | | |
|---|---|---|---|
| EP | 0 820 873 | A2 | 1/1998 |
| JP | 11-115209 | A | 4/1999 |
| JP | 2005-22131 | A | 1/2005 |

* cited by examiner

*Primary Examiner* — Juanita D Stephens
(74) *Attorney, Agent, or Firm* — Birch, Stewart, Kolasch & Birch LLP

(57) ABSTRACT

A method of using a container for a phase change ink cartridge includes inserting the cartridge in the container, transporting the container with the inserted cartridge to an ink jet printer, taking the cartridge out of the container and operatively connecting the cartridge to the printer, and operatively connecting the container to the printer to enable collecting of waste ink produced by the printer in the container. A container for a phase change ink cartridge is also provided for use in a phase change ink jet printer. The container has an inner shape and an outer shape. The inner shape constitutes a fitting enclosure for the cartridge and the outer shape provides a profile for operatively engaging a matching profile of the ink jet printer hardware.

13 Claims, 6 Drawing Sheets

METHOD OF USING A CONTAINER FOR HOUSING AND TRANSPORTING INK CARTRIDGES AND FOR COLLECTING WASTE INK

CROSS-REFERENCE TO RELATED APPLICATIONS

This application claims priority from European Patent Application No. 06113121.5 filed on Apr. 26, 2006, the entire contents of which is hereby incorporated by reference in its entirety.

BACKGROUND OF THE INVENTION

1. Field of the Invention

The present invention pertains to a method of using a container for a phase change ink cartridge. The present invention also pertains to a container for a phase change ink cartridge for use in a phase change ink jet printer.

2. Description of Background Art

Containers for phase change ink cartridges are commonly known in the state of the art. These can be, e.g., disposable plastic bags, compression moulded plastic boxes or cardboard boxes. Generally these containers are used to protect the cartridge during shipment from the manufacturer to the user. Furthermore the container usually displays information regarding the type and the use of the cartridge. Once the user has removed the cartridge from the container to connect the cartridge to the printer, the container is discarded. This forms a waste of valuable resources.

SUMMARY OF THE INVENTION

The present invention overcomes or at least mitigates the disadvantages known in the prior art. To this end, a method of using a container for a phase change ink jet cartridge has been invented comprising inserting the cartridge in the container, transporting the container with the inserted cartridge to an ink jet printer, taking the cartridge out of said container and operatively connecting said cartridge to the printer and operatively connecting the container to the printer to enable collecting of waste ink produced by the printer in said container. In this method the container for the cartridge has a life cycle that starts in a similar manner as the containers in the state of the art. The container is used as a functional package for the cartridge that protects the cartridge during transportation. However, instead of being discarded after the cartridge has been removed, the life cycle of the container is extended by its subsequent use as a waste ink collection container.

In one embodiment, the container is sealed after the cartridge has been inserted into the container. This prevents the accumulation of dust in the container and in the cartridge. Dust particles which migrate into the cartridge will eventually end up in the molten ink. Because the molten ink is filtered prior to being jetted, the presence of dust particles will not immediately result in malfunctioning of the printhead. However the presence of many dust particles in the ink will result in a fast blocking of the filter and hence result in increased maintenance costs.

In another embodiment the inserting of the cartridge into the container and the sealing of the container are performed in an environment having an air pressure that is higher than the surrounding atmospheric air pressure. For example those activities are performed in a down flow clean work station where filtered, clean air is blown into the work station in order to prevent air which is polluted with dust particles from migrating to the container and the cartridge.

In yet another embodiment, after the cartridge has been operatively connected to the printer, the user is alerted to connect the container to the printer. When a yellow, cyan, magenta or black ink cartridge is replaced, the user-interface displays a message reminding the user to replace the waste ink container as well. In this manner the frequency with which the waste ink container is replaced assures that the waste ink container will never contain more than the maximal allowed volume of waste ink. Exceeding the maximal allowed volume of ink in the waste ink container would lead to contamination of the printer and subsequent problems with the replacement of the waste ink container from the printer.

In yet another embodiment the container is operatively connected to the printer by inserting the container into a drawer of the printer. The waste ink is produced upon, e.g., purging of the printhead, when the printhead is in the maintenance position. In other occasions the still fluid waste ink which remains accumulated around the nozzles of the printhead is wiped off with an elastomeric wiper. This causes the waste ink to drip downwards under the influence of gravity. In order to catch the falling drops of waste ink the container is positioned underneath the maintenance position of the printhead. In this embodiment the printer has a drawer that e.g., occupies a space underneath the maintenance position of the printheads. By now opening the drawer, inserting the container into the drawer and closing the drawer, the container is brought into a position to accept the falling drops of waste ink.

In yet another embodiment the container is operatively connected to the printer by slidingly engaging the container with a rail affixed to the printer. In this embodiment the printer body, e.g., has an opening underneath the maintenance position of the printheads. In order to prevent the waste ink drops from falling onto the floor, the container is affixed to the exterior of the printer body in such a manner that it catches the falling waste ink drops. In order to be able to replace the waste ink container conveniently, the container slidingly engages at least one rail on the printer body. The rail e.g., supports the container on its bottom surface or around its upper rim. This allows the container to be easily moved in and out of position.

The present invention also pertains to a container for a phase change ink cartridge for use in a phase change ink jet printer having an inner shape and an outer shape, wherein the inner shape constitutes a fitting enclosure for the cartridge and wherein the outer shape comprises a profile to operatively engage a matching profile of the ink jet printer hardware. The inner shape of the container is preferably complementary to the shape of the cartridge so that the movement of the cartridge in the container is restricted. This offers the highest degree of protection to the cartridge. The outer shape of the container is preferably such that it complements a surface shape of the printer hardware. The complementary shapes allow the container to be operatively connected to the printer hardware in an unambiguous orientation such that it collects the waste ink.

It is noted that in the Phaser series, i.e., the phase change ink jet printer family of Xerox, the waste ink is collected in a plastic drawer. This drawer however is a part of the printer and is not a disposable supply. The user is obliged to empty the drawer from time to time.

In an embodiment of the present invention the container is transparent for visible light. This allows the user to see the cartridge when it is still packed in the container. This reduces the chance that a user applies the wrong cartridge. The container can consist of a transparent plastic material, e.g., polystyrene, polyethylene, polypropylene, polyethelene terephtalate, polycarbonate or polyacrylate-butadiene-styrene.

In another embodiment the container, when containing the cartridge, is sealed with a cover element. The sealing of the container prevents the uptake of dust and reduces the chance of any damage occurring to the cartridge when handling the container. In the case that the container is, e.g., substantially cubically shaped with the upper side being open, the cover element can be of the same dimension and consist of the same material as the container itself. Alternatively the cover element can be a thin foil, preferably a plastic or aluminium foil.

In a further embodiment the cover element is made of cardboard. A cardboard cover element has the advantage that information pertaining to the type and the use of the cartridge can be easily printed on the cardboard using conventional printing technologies. In the case that the container is, e.g., substantially cubically shaped with the upper side being open, the cardboard cover can be of the same dimension or a larger dimension than the container itself. When being displayed in a shop the transparent container will be positioned such that the cardboard cover element will be the side behind the cartridge from the perspective of the client.

In a further embodiment the container comprises a recess in the bottom. In the case that the container is, e.g., substantially cubically shaped with the upper side being open, the bottom side comprises at least one recess. The shape of the recess or the spatial distribution of the recesses forms a keying so as to permit the connection of the container to a matching profile of the printer hardware itself in an unambiguous manner. Because the recess or recesses in the bottom of the container also affect the inner volume of the container their shape or spatial distribution can be such that they contribute to the formation of a fitting enclosure for the cartridge within the container.

BRIEF DESCRIPTION OF THE DRAWINGS

The present invention will now be described by referring to the followint drawings, wherein FIG. 1. is a sectional diagram a phase change ink jet printer.

DETAILED DESCRIPTION OF THE INVENTION

Figure 1:
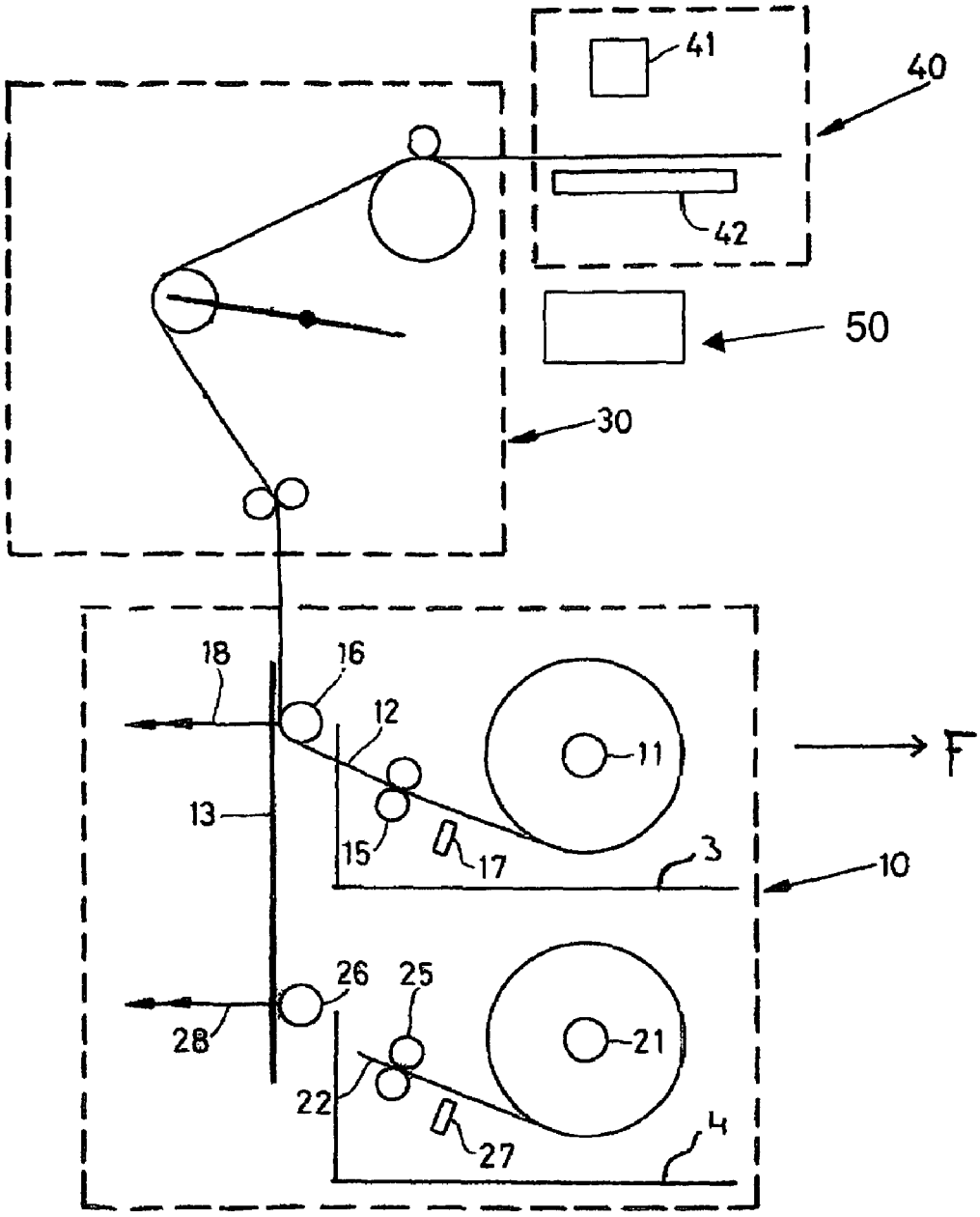

In FIG. 1 a diagram is shown of a printer according to the present invention. This printer is provided with a supply unit 10 which serves for storage and delivery of a substrate for printing. In addition, this printer comprises transport unit 30 which transports the substrate from the supply unit 10 to the print unit 40. Unit 30 also ensures accurate positioning of the substrate in the print zone formed between the print surface 42 and the inkjet printhead 41. In this embodiment, print unit 40 is a conventional engine comprising printhead 41 which is constructed from a number of loose sub-heads, each accommodating one of the colors black, cyan, magenta and yellow. A printhead of this type is described in detail in European patent application EP 1 378 360. Printhead 41 has only a limited print range so that it is necessary to print the image on the substrate in various sub-images. For this purpose, the substrate is transported incrementally in each case in the transit direction (subscan direction) so that a new part of the substrate can be printed in the print zone. When the printhead 41 is not printing it is stationed in the maintenance area (not shown), so that the printhead is not positioned over the substrate. The waste ink collection container 50 is positioned vertically below the printhead 41 when it is stationed in the maintenance area.

In the example illustrated, the substrate 12 originates from core 11 comprising a roll of substrate, which roll is situated in the supply unit 10. The roll is received in drawer 3 of the supply unit. A web of substrate is wound on the core 11 of the roll and has a length of 200 meters. To accommodate the roll in the printer the drawer 3 is provided with a holder (not shown) to support the core in the surroundings of its ends. As a result the roll can be accommodated rotatably in the drawer. The holder comprises two support members received in side plates of the drawer, said members being brought into cooperative connection with the ends of the roll. In this embodiment the supply unit is provided with a second drawer 4 to receive a following roll consisting of core 21 on which a substrate 22 is wound. This substrate 22 can also be delivered by the supply unit for printing. The drawers can be pushed out of the supply unit 10 in the indicated direction F for the withdrawal of the rolls and/or insertion of new rolls. For the transport of the substrate, core 11 is operatively connected to transport means 15, which, in this case comprises a pair of rollers between which a transport nip is formed. A sensor 17 is mounted upstream of means 15 to determine whether there is still substrate on the roll in the relevant holder. The holder is provided with transport means 25 for the transport of a substrate originating from the other roll. Upstream of this means the supply holder is provided with sensor 27 which has the same action as sensor 17. The supply holder is provided with guide elements 16 and 26 to guide the substrates 12 and 22, respectively, to the transport unit 30. Transit path 13 is located downstream of these guide elements. This transit path is used both for the transport of substrate 12 and the transport of substrate 22.

Figure 2:
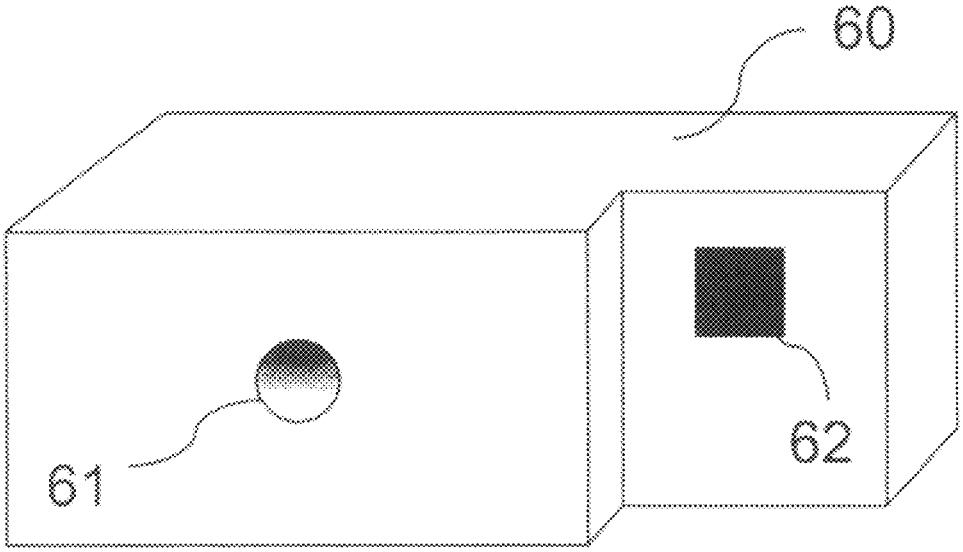
FIG. 2. is a perspective view of a phase change ink cartridge.

In FIG. 2 a phase change ink cartridge 60 is shown. The cartridge 60 contains solid phase change ink pellets (not shown) of one of the colors cyan, magenta, yellow or black. The pellets are of a substantially uniform spherical shape. Alternatively the ink pellets may consist of a coarse irregular granulate. The cartridge further contains a conveyer screw (not shown) for the controlled dispensing of ink pellets through opening 61 to the printer. The conveyer screw is driven by a stepper motor in the printer to which the conveyer screw is operatively connected upon connection of the cartridge to the printer.

The cartridge further contains a memory tag 62 storing information about the ink in the cartridge. A coupler on the printer establishes a communication link with the memory tag on the cartridge as the cartridge is being connected to the printer. The coupler on the printer receives the information of the memory tag. The coupler then determines from this information what the optimal engine setpoints are for use of the ink from this cartridge.

Figure 3:
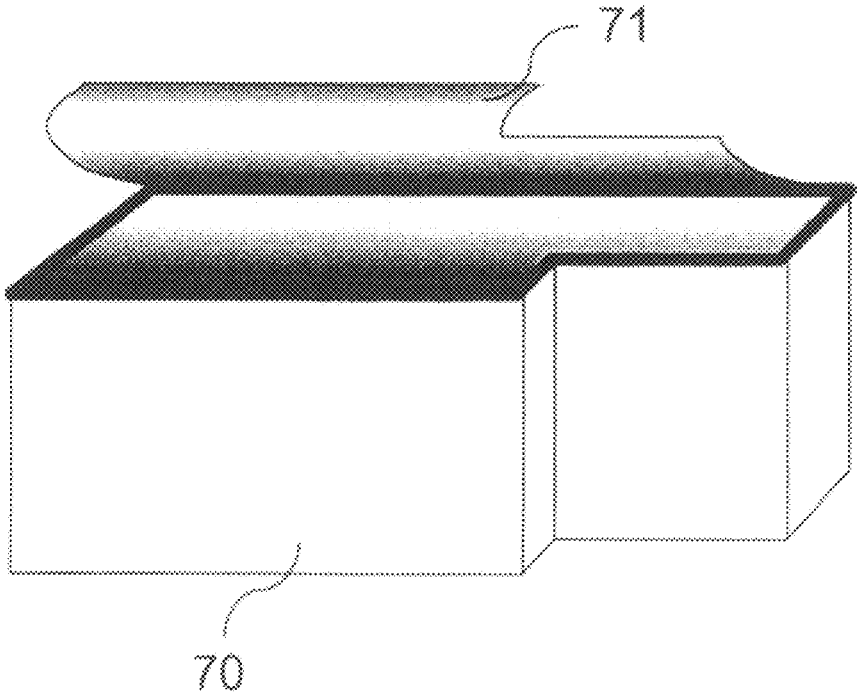
FIG. 3. is a perspective view of a container for a phase change ink jet cartridge.

In FIG. 3 a container 70 for accommodating a phase change ink jet printer is shown. The inner shape of the container is shaped as to form a fitting enclosure for the ink jet cartridge. In this example the outer shape of the container is practically identical to its inner shape. Alternative embodiments exist in which the inner shape deviates from the outer shape. In one embodiment the container is substantially cubically shaped and the inner sides of the container are invested with a layer of polystyrene foam that follows the circumference of the cartridge. In another embodiment the container sides consist of two layers of plastic which are independently shaped.

The container 70 has a plastic foil 71 as a cover element that is used to seal the container when it contains a cartridge 60 as shown in FIG. 2.

Figure 4A:
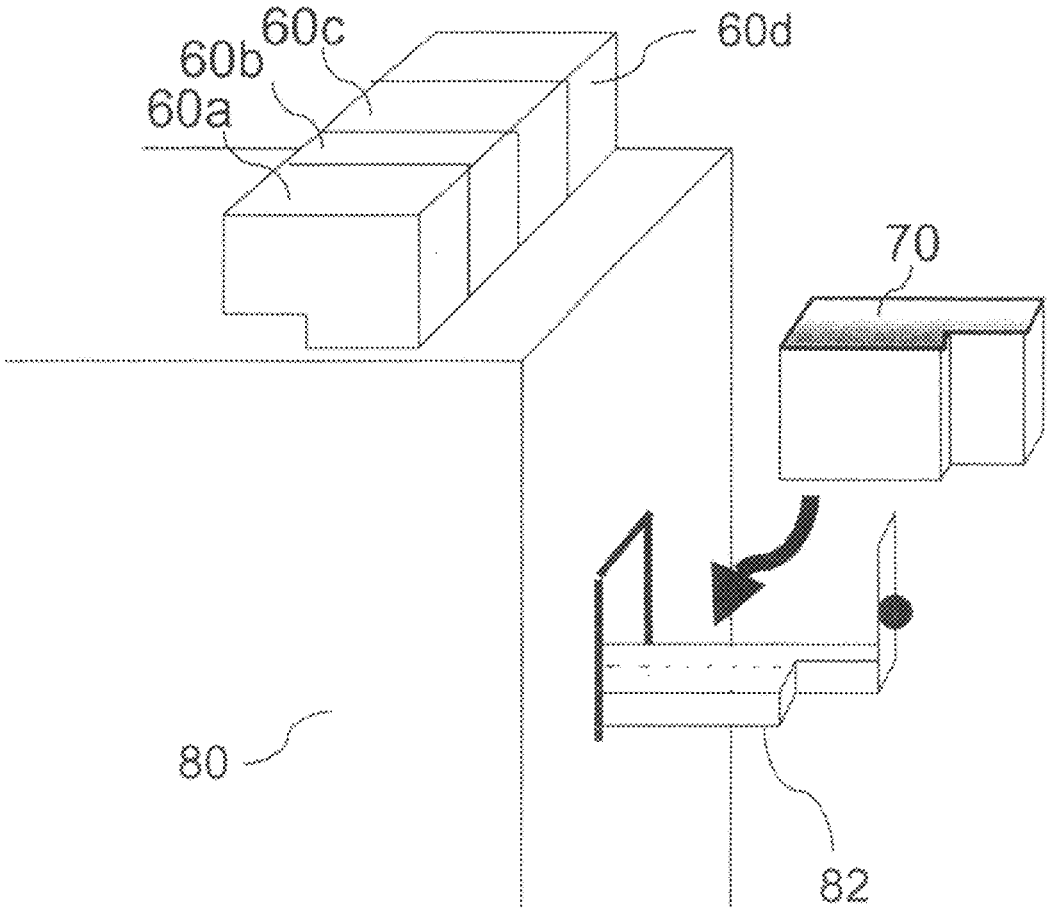
FIGS. 4*a* and 4*b* are perspective views of a phase change ink jet printer, with the container for the phase change ink cartridge in the open and substantially closed position
Figure 4B:
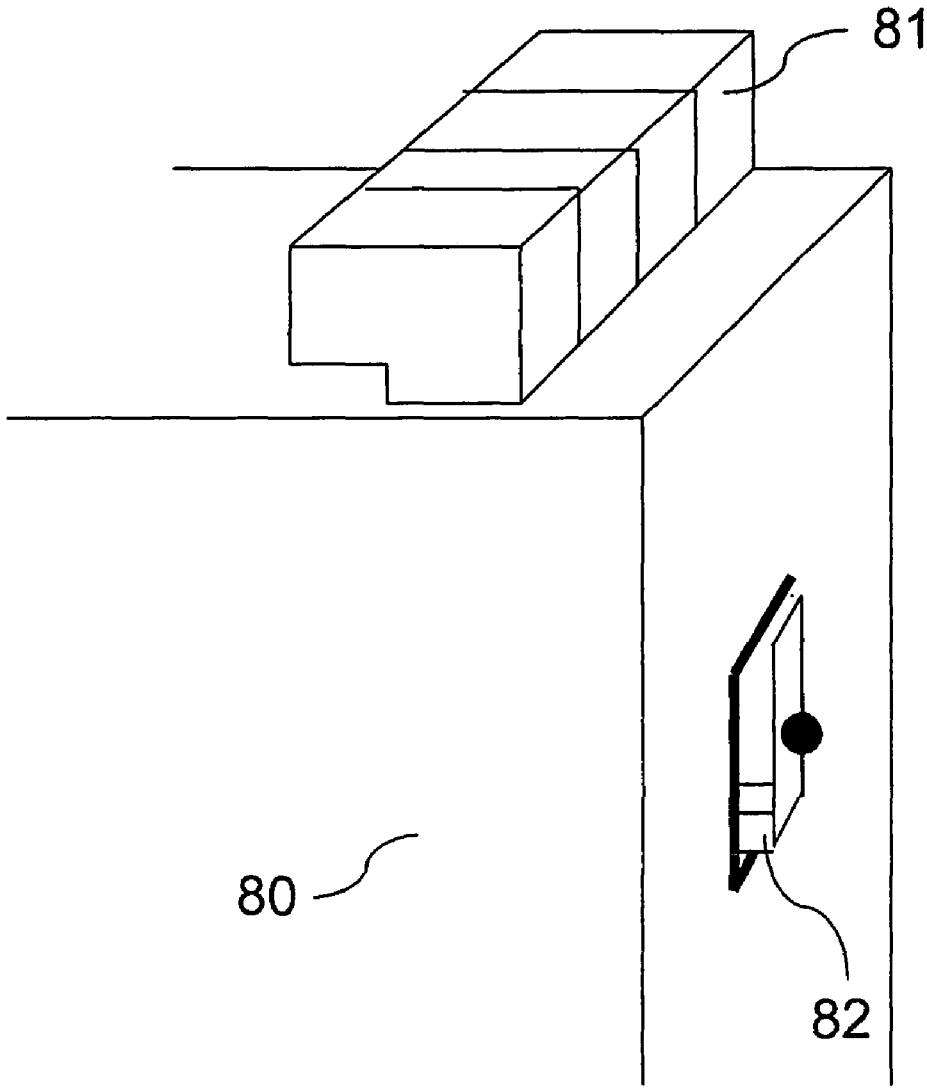

FIGS. 4*a* and 4*b* show a phase change ink jet printer 80. Four cartridges 60*a-d* have been operatively connected to the printer, i.e., one cartridge for each color cyan, magenta, yellow and black. A drawer 82 for accepting the waste ink container 70 is shown when it is open (FIG. 4*a*) and when it is closed (FIG. 4*b*). The horizontal perimeter of the drawer has a profile that matches the profile of the container 70 (FIG. 3). This allows the drawer 82 to operatively engage the container 70. The container 70 can only be inserted into the drawer 82 in its proper orientation, in order to effectively collect waste ink when the drawer is closed.

Figure 4C:
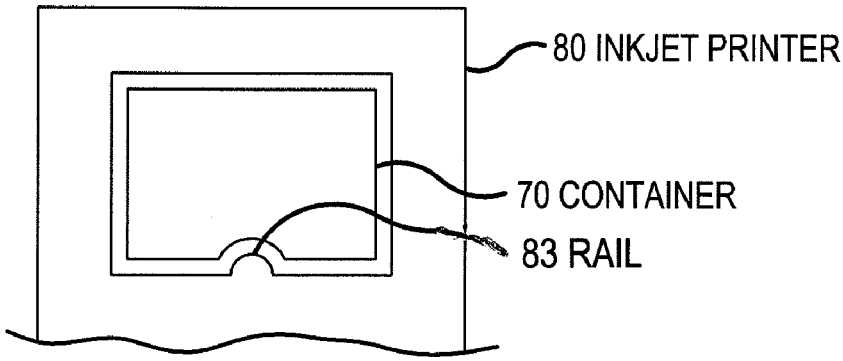
FIG. 4*c* shows the use of a rail for operatively connecting the container to the printer.

FIG. 4*c* shows the container 70 operatively connected to the printer by slidably engaging the container with a rail 83 affixed to the printer.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim.

What is claimed is:

1. A method of using a container for a phase change ink cartridge comprising:

inserting the cartridge into the container;

transporting the container with inserted cartridge to an ink jet printer;

taking the cartridge out of said container and operatively connecting said cartridge to the printer; and operatively connecting the container to the printer to enable the collection of waste ink produced by the printer in said container.

2. The method according to claim 1, wherein after inserting the cartridge into the container, the container is sealed.

3. The method according to claim 1, wherein the inserting of the cartridge into the container and the sealing of the container are performed in an environment having an air pressure that is higher than the surrounding atmospheric air pressure.

4. The method according to claim 1, wherein the cartridge has been operatively connected to the printer, the user is alerted to connect the container to the printer.

5. The method according to claim 1, wherein the container is operatively connected to the printer by inserting the container into a drawer of the printer.

6. The method according to claim 1, wherein the container is operatively connected to the printer by slidingly engaging the container with a rail affixed to the printer.

7. The method of claim 1, wherein after the cartridge is removed from the container, the container is re-used by slidably introducing the container into the printer for the collection of said waste ink.

8. A container for a phase change ink cartridge to be used in a phase change ink jet printer, said container comprising:

an inner shape; and an outer shape, wherein the inner shape constitutes a fitting enclosure adapted to receive the ink cartridge and the outer shape contains a profile that operatively engages a matching profile of the ink jet printer for the introduction of the container into the printer for use as a waste ink storage after the phase change ink cartridge has been removed.

9. The container according to claim 8, wherein the container is transparent for visible light.

10. The container according to claim 8, wherein the container, when containing a cartridge, is sealed with a cover element.

11. The container according to claim 10, wherein the cover element is made of cardboard.

12. The container according to claim 8, wherein the container has a bottom with a recessed profile.

13. The container of claim 8, wherein the profile of the outer shape of the container and the matching profile of the ink jet printer provides for the slidable introduction of the container into the printer.

* * * * *